United States Patent [19]

Exel

[11] 3,993,239

[45] Nov. 23, 1976

[54] STACKABLE CARDBOARD BOX, IN PARTICULAR FOR FRUIT AND SIMILAR PRODUCTS

[76] Inventor: Heribert G. Exel, Wienerbruckstrasse 104, Sudstadt, Vienna, Austria, A2344

[22] Filed: Apr. 23, 1975

[21] Appl. No.: 570,897

[30] Foreign Application Priority Data

Mar. 4, 1975 Germany ..... 2509298

[52] U.S. Cl. ..... 229/23 R; 229/34 HW; 229/15

[51] Int. Cl.[2] ..... B65D 5/35; B65D 5/22

[58] Field of Search ..... 299/23 R, 34 HW, 15, 299/27

[56] References Cited

UNITED STATES PATENTS

| | | | |
|---|---|---|---|
| 1,622,525 | 3/1927 | Lemon | 229/23 R |
| 2,112,433 | 3/1938 | Boeye | 229/23 R |
| 2,397,135 | 3/1946 | Frankenstein | 229/34 HW |
| 2,657,849 | 11/1953 | Paul et al. | 229/23 R |
| 3,040,954 | 6/1962 | Salmon | 229/23 R |

*Primary Examiner*—William T. Dixson, Jr.
*Assistant Examiner*—Douglas B. Farrow
*Attorney, Agent, or Firm*—Beveridge, DeGrandi, Kline & Lunsford

[57] ABSTRACT

A stackable cardboard box has a rectangular bottom wall and integrally formed inwardly inclined side walls attached by way of flaps to separately formed vertically extending generally trapezoidal end walls whereby the formed boxes have a greater transverse dimension at the bottom than at the top to facilitate stacking and ventilation.

7 Claims, 8 Drawing Figures

Fig.1
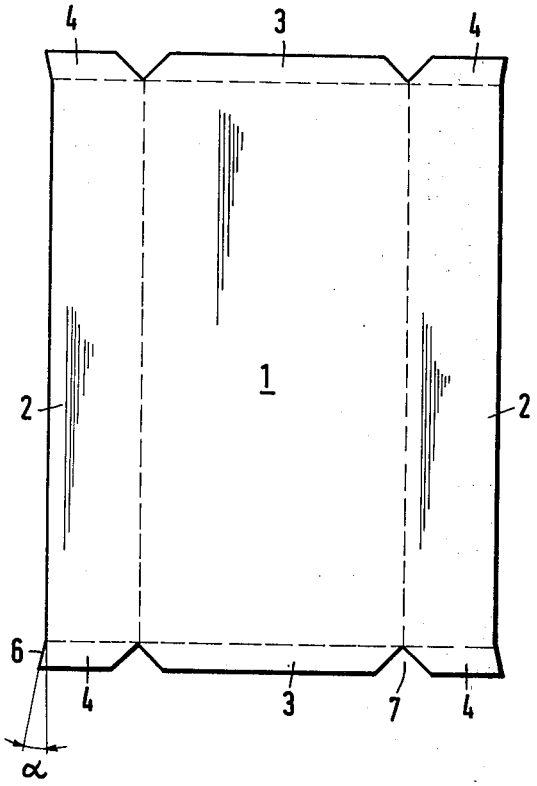
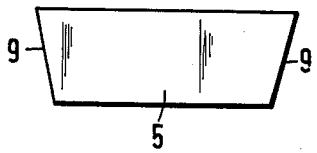
Fig.2
Fig.3
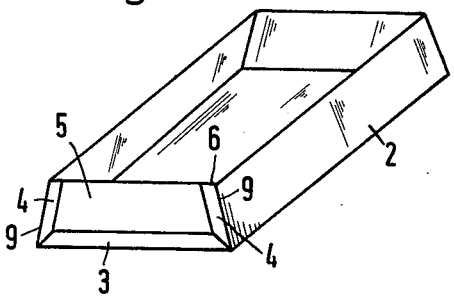
Fig.4
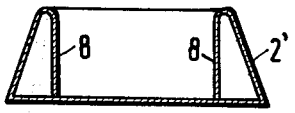

STACKABLE CARDBOARD BOX, IN PARTICULAR FOR FRUIT AND SIMILAR PRODUCTS

BACKGROUND OF THE INVENTION

1. Field of the Invention

This invention relates to stackable boxes or cartons in particular for fruit and similar products and consisting of a bottom, two side walls, and two end walls which are attached to the bottom and side walls by way of flaps.

2. Description of the Prior Art

The boxes customarily used for storing and transporting fruit and similar products have perpendicular lateral walls, so that the surfaces limited by the bottom of the box and by the upper edges of the lateral walls are essentially of the same size. In order to form a stack of such boxes, it is necessary to place the individual boxes as precisely as possible one on top of the other. This requires care and skill.

Therefore, it is the primary purpose of the present invention to improve the initially described box in a simple manner and in such a way that it can be stacked quickly and simply and that the stacks which develop are as stable as possible.

SUMMARY OF THE INVENTION

In the attainment of the foregoing and other objects, an important feature of the invention resides in forming the opposed end walls of the box with lateral edges inclined toward the inside and forming the outline of a regular trapezoid, with the side walls of the box abutting against said lateral edges in the assembled state so as to have the same inclination toward the inside.

An important advantage of this shape of a box is the fact that, because of the difference in the size of the bottom surface and of the surface limited by the upper edges of the lateral walls, an area of permissible limits develops which will guarantee a stable stack even in the case of boxes not precisely superposed within certain limits. The area of permissible limits at the same time can be selected in a simple way by a corresponding selection of the slope of the lateral walls. As a result of these measures, less care is required during stacking and consequently the speed of stacking can be increased considerably. A further advantage of this shape of a box will be that channels remain between the boxes whenever several stacks are standing side by side, so that sufficient ventilation or air circulation will be assured.

One advantage of the box according to this invention resides in the fact that the lateral or side walls are extended at their ends by integrally formed flaps which are bent toward the inside in overlapping relation with the outer surface of the ends of the boxes which are supported by the bottom. Thus the flaps represent a reinforcement increasing the stacking strength of the box.

This shape of the box with the reinforced vertical end walls will assure that during the stacking of said boxes, the lateral walls will not bend still further inward under the weight of the product contained therein which could lead to uneven, crooked stacks.

A further advantage of the invention wherein the box is made from corrugated paperboard resides in forming the end walls of the box as separate parts which are attached to the bottom surface in such a way that the corrugations of the cardboard run vertically. As a result of forming the end walls separately, the corrugations in the side walls can also extend upwardly so that an even resistivity of all walls of the box will be achieved, which likewise furthers the stability of the stack.

BRIEF DESCRIPTION OF THE DRAWINGS

The foregoing and other advantages of the invention will become more apparent from the detailed description contained herein, taken in conjunction with the drawings, in which:

FIG. 1 is a plan view of the blank from which the bottom and two side walls are formed;

FIG. 2 is a plan view of one of the end walls of the box;

FIG. 3 is a perspective view of the folded box; and

FIG. 4 is a sectional view of an alternate embodiment of the box with extending side walls supported inwardly.

DESCRIPTION OF THE PREFERRED EMBODIMENTS

Figure 5:
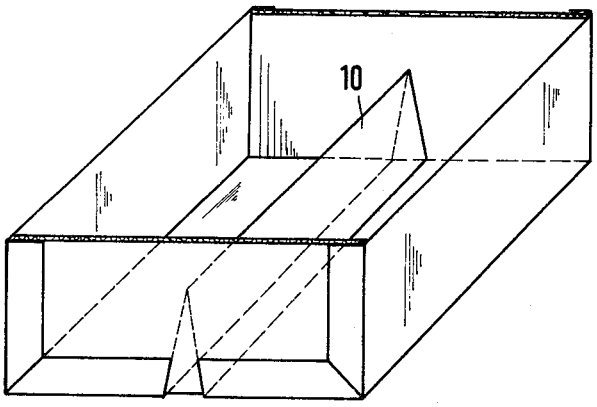
FIGS. 5–8 are additional embodiments of inventive boxes.

Referring now to the drawings, it is seen that the box is constructed from three separate parts, or blanks, one of which is shown in FIG. 1, and consists of bottom panel 1 and side walls 2, each of which has two integrally formed terminal flaps 3 or 4 on which the lateral edges of the end walls 5 are glued or are attached in any other suitable manner. The part which constitutes the end walls, shown in FIG. 2, has a trapezoid shaped form and is connected with its longer base side, e.g. by gluing, with the inside surface of the corresponding terminal flaps 3 of bottom panel 1. The inclined side edges 9 of the end walls 5 are connected in the same manner with the terminal flaps 4 of the side walls 2 so that whenever the box is folded and assembled, the lateral walls 4 are inclined upwardly and inwardly toward one another as is seen in FIG. 3.

In order for the upper edge 6 of the terminal flap 4 to coincide precisely with the upper edge of the part 5 of the front wall when the box is assembled, said edge 6 of the terminal flap 4 extends outward at an angle $\alpha$. The angle $\alpha$ corresponds to the angle which forms the sloping edge 9 of the trapezoid-like part 5 with respect to a vertical line. In the same manner, the terminal flaps 3 and 4 are separated by an angular notch 7, the opening of which is $90° + 2\alpha$ so that during the joining together of the terminal flaps 3, 4 behind the end panel 5, their adjoining edges meet, as can be seen from FIG. 3.

A modified form of the box is shown in FIG. 4. This embodiment differs from the embodiment of FIG. 3 only in that the side walls 2' have integrally formed thereon rectangular panels 8 adapted to be folded inwardly and perpendicularly downward in order thus to create vertical inside walls, the free bottom edges of which are supported by the bottom of the box. In this manner a box is obtained in which the lateral walls have substantially greater stacking strength although the boxes have the same outside shape as the embodiment shown in FIGS. 1–3.

It is well known that corrugated cardboard possesses substantially different strength in directions perpendicular and parallel to the direction of the corrugations. Accordingly, the parts of the box advantageously will be punched in such a way that the corrugations run perpendicularly in relation to the longitudinal edges of the side walls 2 and to the end walls 5, since in that way an even resistivity of all lateral walls of the box will be assured, which has an advantageous effect on the stability of the stack.

The box may also be used e.g. as display chute or as lost casing in the building industry.

FIG. 5 shows a box, from the bottom of which a centric separating wall or reinforcing wall 10 with inclined side walls extends upwardly.

Figure 6:
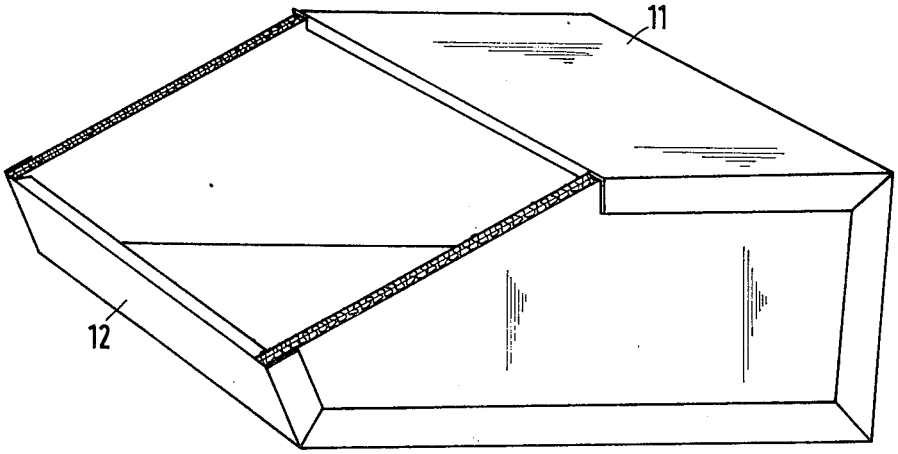

FIG. 6 shows a display chute, the upper side of which is partly covered with a lid 11 and the one side wall 12 of which extends inclined upwardly. Between the side wall 12 and the lid 11 is an aperture with inclined side edges. Hereby a well accessible aperture is formed, through which e.g. a customer may see the goods in the display chute and take same out. Even if several such chutes are stacked above each other, the individual chutes remain well accessible.

Figure 7:
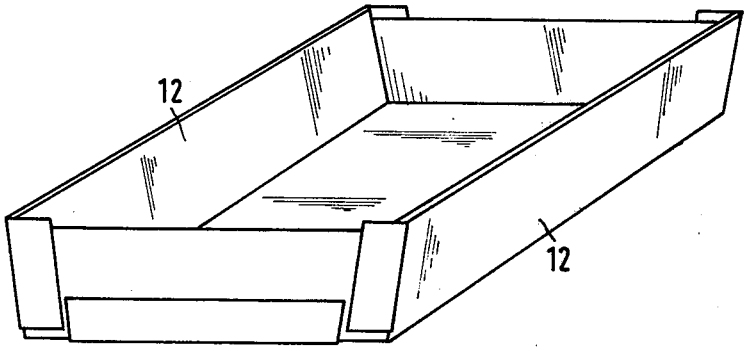

FIG. 7 shows an embodiment of the inventive box with an upwardly extending cross-section, i.e. the side walls 12 extend inclined upward and outwardly from the bottom of the box.

Figure 8:
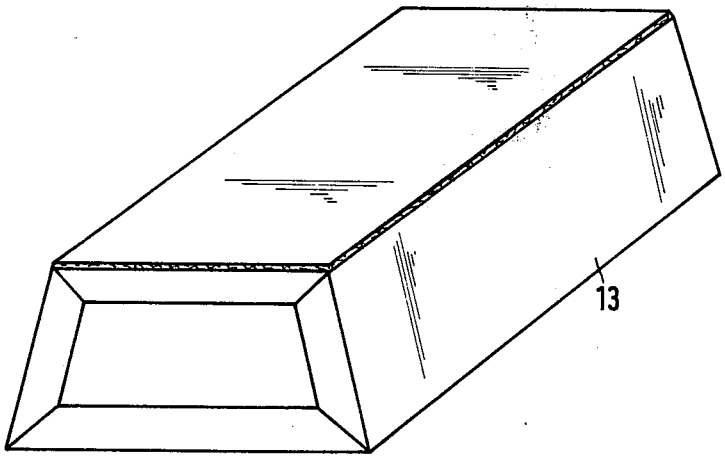

FIG. 8 shows a structural element, the side walls 13 of which extend inclined upward and inwardly in order to give the structural element a greater static stability as it is e.g. necessary, if this structural element is used as lost casing in the building industry, e.g. for casing groined ceilings.

What I claim is:

1. A stackable box especially useful in packaging and handling fruit and similar products, said box being formed from three separate blanks including a first blank having a central panel defining the bottom wall of the box and two side panels each defining one side wall of the box and second and third substantially identical blanks one defining each end wall of the box when assembled with said first blank, said side panels and central panel each having assembly flanges integrally formed on their opposed ends overlaying and attached to the outer surface of said second and third blanks along the bottom and side edges thereof when said blanks are assembled to form said box, the improvement wherein each of said blanks is formed from corrugated paperboard with the corrugations in said end walls and in said side panels running generally vertically, and wherein said bottom panel includes a portion extending upwardly from said bottom wall and defining a separating wall in said box, said separating wall being in the general form of an inverted V with the side areas thereof being separated at the bottom of said box.

2. The stackable box as defined in claim 1 wherein said second and third blanks have generally parallel top and bottom edges and lateral edges extending inwardly and upwardly from the bottom edge whereby the top of the box is smaller in area than the bottom of said box.

3. The box as defined in claim 2 further comprising generally rectangular extension panels integrally formed on the top edge of said side panels, said extension panels extending vertically downward inside said box with the bottom edges of said extension panels supported by the bottom panel of the box.

4. The box as defined in claim 2 wherein said flaps formed on said side walls are formed with an angular extension projecting outwardly at an angle $\alpha$ relative to the edge thereof which defines the top of the box, the angle $\alpha$ being equal to the angle of inclination of the side walls with regard to the vertical.

5. The box as defined in claim 4 further comprising a notch with an angle of $90° + 2\alpha$ provided between the adjacent edges of the flaps formed on said side walls and the flaps of the bottom panel when the blank forming said bottom panel and said side walls is in a planar condition whereby said adjacent edges are in edge-to-edge relation when said box is assembled.

6. The box as defined in claim 1 wherein one of said two side walls extends inclined upwardly and toward a box opening having sloping side edges.

7. The box as defined in claim 1 whereby said box is closed on all sides and whereby two side areas opposite to one another extend inlined upward and inwardly to result in a construction element, e.g. an element of a lost casing, which is statically loadable.

* * * * *